US007209680B2

(12) United States Patent
Kweon

(10) Patent No.: US 7,209,680 B2
(45) Date of Patent: Apr. 24, 2007

(54) PROCESS CARTRIDGE AND AN IMAGE FORMING APPARATUS HAVING THE SAME

(75) Inventor: Dae-Seob Kweon, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 11/216,023

(22) Filed: Sep. 1, 2005

(65) Prior Publication Data

US 2006/0051126 A1 Mar. 9, 2006

(30) Foreign Application Priority Data

Sep. 9, 2004 (KR) ..... 10-2004-0072333

(51) Int. Cl.
*G03G 21/16* (2006.01)

(52) U.S. Cl. ..... 399/111; 399/113

(58) Field of Classification Search ..... 399/111, 399/358, 360

See application file for complete search history.

(56) References Cited

U.S. PATENT DOCUMENTS 4,849,791 A * 7/1989 Hagihara et al. ..... 399/360
2003/0072584 A1* 4/2003 Cho ..... 399/110

FOREIGN PATENT DOCUMENTS

| | | |
|---|---|---|
| JP | 07-049611 | 2/1995 |
| JP | 2002-311696 | 10/2002 |
| JP | 2004-050470 | 2/2004 |
| KR | 10-0382657 | 5/2003 |

* cited by examiner

*Primary Examiner*—David M. Gray
*Assistant Examiner*—Bryan Ready
(74) *Attorney, Agent, or Firm*—Roylance, Abrams, Berdo & Goodman, L.L.P.

(57) ABSTRACT

An image forming apparatus comprises a photoconductive unit having a waste toner outlet and a shutter for closing the waste toner outlet, a developing unit removably mounted to the photoconductive unit and having a waste toner storage for storing a waste toner discharged through the waste toner outlet, a main body for receiving and supporting the photoconductive unit and the developing unit and having a door, and an opening/closing member moving in association with an opening and closing movement of the door, thereby moving the shutter to a position for opening the waste toner outlet, wherein the shutter moves to the position for opening the waste toner outlet by mounting both the photoconductive unit and the developing unit and closing the door at the same time.

10 Claims, 8 Drawing Sheets

PROCESS CARTRIDGE AND AN IMAGE FORMING APPARATUS HAVING THE SAME

CROSS-REFERENCE TO RELATED APPLICATIONS

This application claims the benefit under 35 U.S.C. §119 (a) of Korean Patent Application No. 2004-72333 filed in the Korean Intellectual Property Office on Sep. 9, 2004, the entire disclosure of which is hereby incorporated by reference.

BACKGROUND OF THE INVENTION

1. Field of the Invention

The present invention relates to an image forming apparatus. More particularly, the present invention relates to an improved process cartridge removably mounted in an image forming apparatus, and an image forming apparatus having the same.

2. Description of the Related Art

Image forming apparatuses refer to devices which use an electrophotographic process, such as a photocopier, a printer, a facsimile and a word processor. A process cartridge is a kind of a subassembly detachably mounted to a main assembly, which integrally comprises a photoconductive medium, an electrifying unit, a developing unit and a cleaning unit.

The image forming apparatus using the electrophotographic process generally uses a process cartridge. Since the process cartridge enables a user to operate the apparatus without a special skill, thereby improving operability, image forming apparatuses employing the process cartridge are being widely used.

The process cartridge comprises a photoconductive unit, a developing unit and an opening/closing unit for opening and closing a waste toner outlet provided to the photoconductive unit.

The photoconductive unit comprises a photoconductive medium where an electrostatic latent image is formed and a photoconductive unit frame having the waste toner outlet for discharging a waste toner. The developing unit comprises a developing roller, a developing unit frame for supporting the developing roller, and a waste toner storage for storing the waste toner discharged through the waste toner outlet of the photoconductive unit. Preferably, the photoconductive unit and the developing unit are separably connected to each other.

As shown in FIG. 1A and FIG. 1B, the opening/closing unit comprises a shutter 10 mounted to the photoconductive unit frame 1 to move between first and second positions, thereby opening and closing the waste toner outlet 2, an elastic member 20 for elastically biasing the shutter 10 toward the second position where the waste toner outlet 2 is closed, and an opening/closing member 30 for moving the shutter 10 to the first position where the waste toner outlet 2 is opened.

The opening/closing member 30 operates in association with opening and closing of a door (not shown) of the image forming apparatus. For example, when the door (not shown) is closed, the opening/closing member 30 moves the shutter 10 toward the first position, as shown in FIG. 1B. Whereas, when the door (not shown) is open, the opening/closing member 30 returns the shutter 10 to the second position by the elastic recovery force of the elastic member 20, as shown in FIG. 1A.

However, in the conventional process cartridge of the image forming apparatus as the above, especially, if the photoconductive unit and the developing unit have different lifespans from each other, the waste toner may leak when a user separates the developing unit for replacement and closes the door, when the process cartridge is mounted in the image forming apparatus, since the shutter 10 moves to the first position by the opening/closing member 30, thereby opening the waste toner outlet 2. The leakage of toner may contaminate the inside of the image forming apparatus, and accordingly deteriorate image quality.

SUMMARY OF THE INVENTION

An aspect of the present invention is to solve at least the above problems and/or disadvantages and to provide at least the advantages described below. Accordingly, an aspect of the present invention is to provide a process cartridge that prevents a waste toner outlet from being opened even though a door of an image forming apparatus is closed, or when a developing unit is separated due to replacement, in order to restrain undesired leakage of a toner.

In order to achieve the above-described aspects of the present invention, there is provided a photoconductive unit which comprises a waste toner outlet and a shutter for closing the waste toner outlet, and a developing unit, which is removably mounted to the photoconductive unit and comprises a waste toner storage for storing a waste toner discharged through the waste toner outlet, and removably mounted in a main body of an image forming apparatus. The shutter moves in association with an opening and closing operation of a door of the image forming apparatus between a first position, where the waste toner outlet is opened, and a second position, where the waste toner outlet is closed. The process cartridge further comprises an auxiliary opening/closing member provided in the developing unit that is disposed between the shutter and an opening/closing member of the door by mounting the photoconductive unit and the developing unit in order to transmit to the shutter an external force applied to the opening/closing member.

The image forming apparatus further comprises a first elastic member for elastically supporting the shutter toward the second position.

The auxiliary opening/closing member comprises a housing having a hole formed in the moving direction of the shutter; a moving bar movably disposed in the hole of the housing and protruding from the housing as the opening/closing member moves to the first position of the shutter; and a second elastic member elastically supporting the moving bar to return the protruded moving bar to its initial position.

The first elastic member is formed as a tension coil spring of which one end is connected to the photoconductive unit and the other end is connected to the shutter, and the second elastic member is formed as a compression coil spring enclosing the outer circumference of the moving bar.

According to another aspect of the present invention, an image forming apparatus comprises a photoconductive unit having a waste toner outlet and a shutter for closing the waste toner outlet, a developing unit removably mounted to the photoconductive unit and having a waste toner storage for storing waste toner discharged through the waste toner outlet, a main body receiving and supporting the photoconductive unit and the developing unit and having a door, and an opening/closing member moving in association with an opening and closing movement of the door, thereby moving the shutter to a position for opening the waste toner outlet, wherein the shutter moves to the position for opening the waste toner outlet by mounting both the photoconductive unit and the developing unit and closing the door at the same time.

The waste toner outlet is not opened if the door is closed with the developing unit unmounted, or if the door is not closed.

According to yet another aspect of the present invention, an image forming apparatus comprises a photoconductive unit having a waste toner outlet and a shutter for closing the waste toner outlet; a developing unit removably mounted to the photoconductive unit and having a waste toner storage for storing waste toner discharged through the waste toner outlet and an auxiliary opening/closing member disposed close to the shutter to help open the shutter; a main body receiving and supporting the photoconductive unit and the developing unit and having a door; and an opening/closing member moving in association with an opening and closing movement of the door, thereby moving the shutter to a position for opening the waste toner outlet, wherein the auxiliary opening/closing member is disposed between the shutter and the opening/closing member by mounting the photoconductive unit and the developing unit, and when the door is closed, the opening/closing member operates the auxiliary opening/closing member so that the auxiliary opening/closing member moves the shutter to a position for opening the waste toner outlet.

The waste toner outlet is not opened if the door is closed with the developing unit unmounted, or if the door is not closed.

According to still another aspect of the present invention, an image forming apparatus comprises a process cartridge having a photoconductive unit, which comprises a waste toner outlet, and a developing unit removably mounted to the photoconductive unit and comprising a waste toner storage for storing a waste toner discharged through the waste toner outlet; a main body receiving and supporting the process cartridge and having a door; and an opening/closing unit opening and closing the waste toner outlet of the photoconductive unit in association with an opening and closing operation of the door, wherein the opening/closing unit comprises a shutter moving between a first position for opening the waste toner outlet and a second position for closing the waste toner outlet; an opening/closing member formed at the door to move the shutter to the first position; and an auxiliary opening/closing member provided in the developing unit, being disposed between the shutter and the opening/closing member by mounting the photoconductive unit and the developing unit in order to transfer to the shutter an external force applied to the opening/closing member.

BRIEF DESCRIPTION OF THE DRAWING FIGURES

The above aspect and other features of the present invention will become more apparent by describing in detail exemplary embodiments thereof with reference to the attached drawing figures, wherein.

Throughout the drawings, it should be understood that like reference numbers refer to similar features, elements and structures.

DETAILED DESCRIPTION OF EXEMPLARY EMBODIMENTS

Hereinafter, an embodiment of the present invention will be described in detail with reference to the accompanying drawing figures.

The matters defined in the description such as a detailed construction and elements are provided to assist in a comprehensive understanding of the invention. Well-known functions or constructions are omitted for the sake of clarity and conciseness.

Figure 1A:
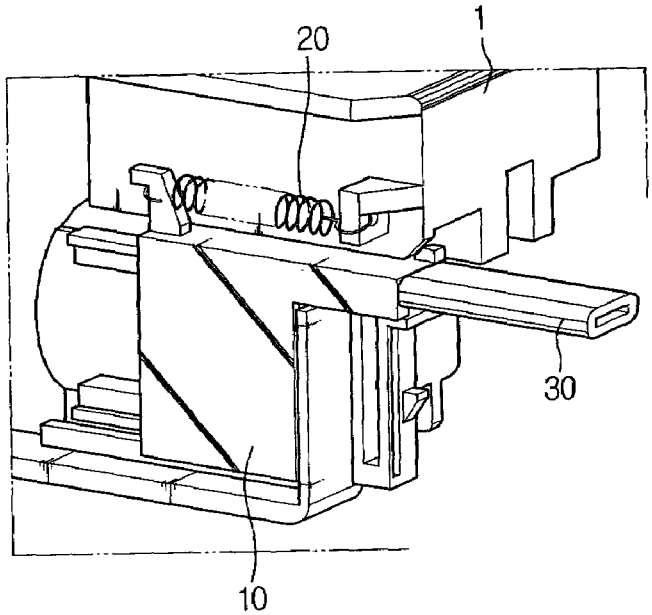
FIG. 1A (PRIOR ART)
FIGS. 1A and 1B are views for explaining the structure and the operation of an opening/closing unit for a waste toner outlet provided to a process cartridge of a conventional image forming apparatus.
Figure 1B:
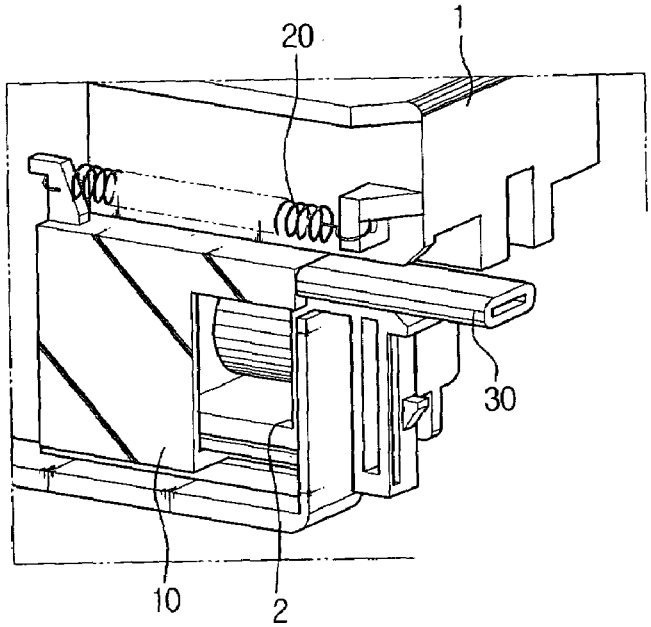
FIG. 1B (PRIOR ART)
Figure 2:
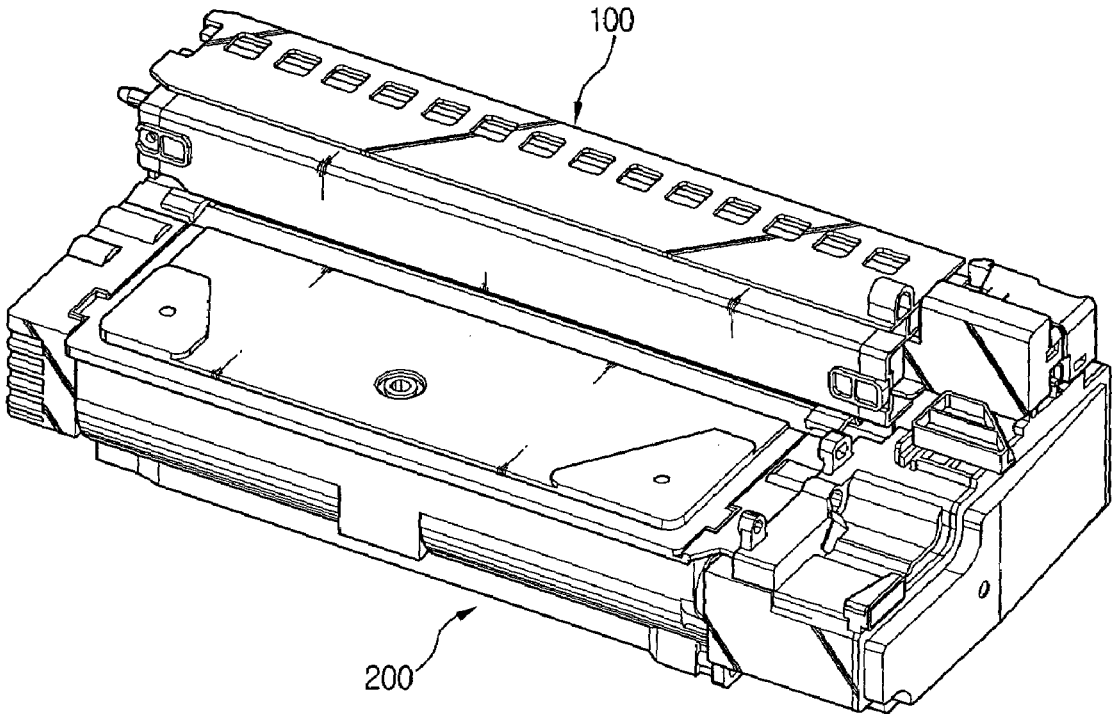
FIG. 2 is a perspective view of a process cartridge of an image forming apparatus, according to an embodiment of the present invention.
Figure 3:
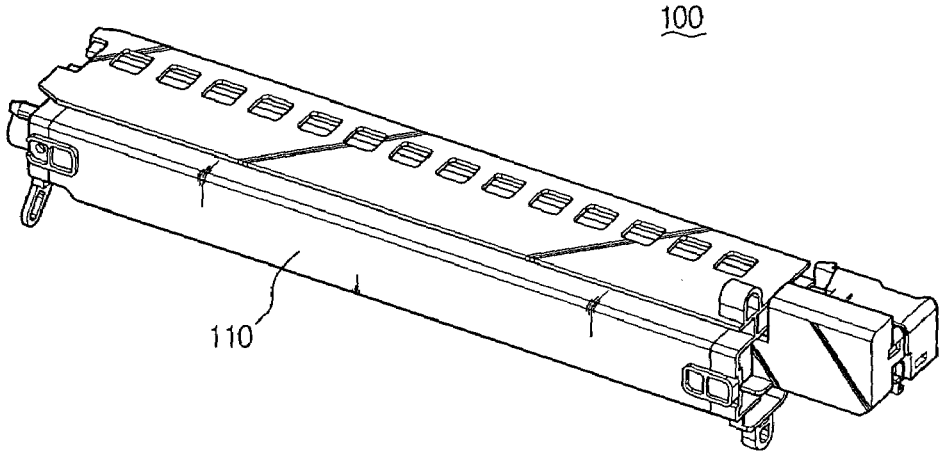
FIG. 3 is a perspective view of a photoconductive unit of FIG. 2.
Figure 4:
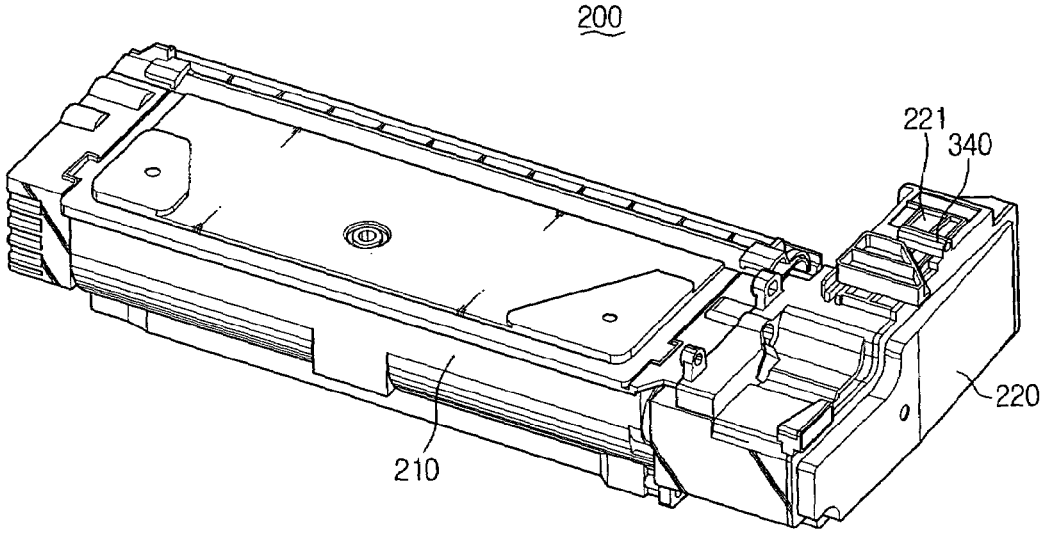
FIG. 4 is a perspective view of a developing unit of FIG. 2.

In FIGS. 2 to 4, a reference number 100 denotes a photoconductive unit, and a reference number 200 denotes a developing unit.

Referring to FIGS. 2 to 4, the photoconductive unit 100 comprises a photoconductive medium (not shown) and a photoconductive unit frame 110 for receiving and supporting the photoconductive medium. The photoconductive unit frame 110 has a waste toner outlet 120 (FIG. 7B) for discharging a waste toner.

The developing unit 200 comprises a developing roller (not shown), a developing unit frame 210 for receiving and supporting the developing roller and a waste toner storage 220 for storing the waste toner discharged through the waste toner outlet 120. The waste toner storage 220 comprises a waste toner inlet 221.

The photoconductive unit 100 and the developing unit 200 are separably connected with each other in a manner that the waste toner outlet 120 and the waste toner inlet 221 correspond to each other. The waste toner outlet 120 is selectively opened by an opening/closing unit 300 comprising an auxiliary opening/closing member 340, which will be described in more detail below.

As shown in FIGS. 5 to 7B, the opening/closing unit 300 comprises a shutter 310, a first elastic member 320, an opening/closing member 330 and an auxiliary opening/closing member 340.

The shutter 310 is mounted to the photoconductive unit frame 110 to move in a sliding manner between a first position for opening the waste toner outlet 120 and a second position for closing the waste toner outlet 120.

The first elastic member 320 elastically supports the shutter 310 in the second position where the waste toner outlet 120 is closed. The first elastic member 320 is made of a tension coil spring, of which one end is connected to the shutter 310, and the other end is connected to the photoconductive unit frame 110. To this end, the shutter 310 and the photoconductive unit frame 110 respectively comprises spring fixing portions 311 and 111. The first elastic member 320 is not limited to the tension coil spring as in this embodiment, but can be implemented by any other means capable of elastically supporting the shutter 310 toward the second position.

The opening/closing member 330 moves to the first and the second positions of the shutter 310 and provides a force for pushing the shutter 310 when moving to the first position. In this embodiment, the opening/closing member 330 is configured to operate in association with an opening and closing movement of a door 410 of a main body 400 of the image forming apparatus. In a state that the door 410 is not closed, the shutter 310 does not move to the first position although a process cartridge 500 (FIG. 6) is mounted to the main body 400 of the image forming apparatus.

Figure 7A:
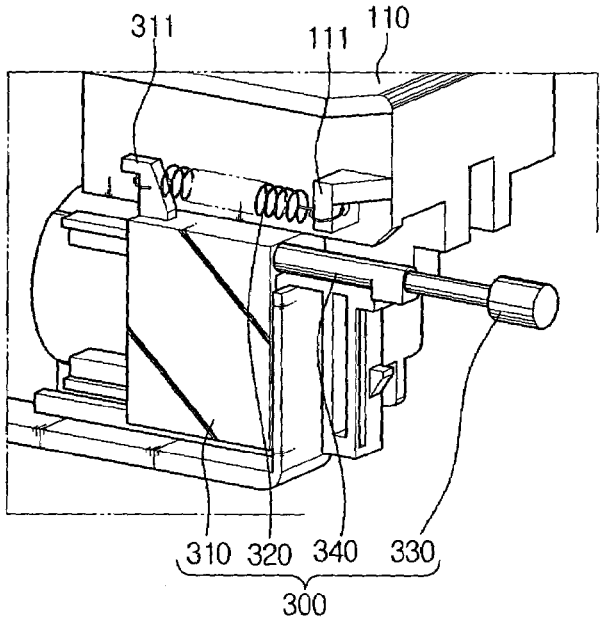
FIGS. 7A and 7B are views for explaining the operation of a opening/closing unit for a waste toner outlet of a process cartridge according to an embodiment of the present invention.

The auxiliary opening/closing member 340 is preferably mounted to the developing unit 200. By mounting the photoconductive unit 100 and the developing unit 200 adjacent to one another, the auxiliary opening/closing member 340 is disposed between the shutter 310 and the opening/closing member 330, as shown in FIG. 7A, thereby transferring an external force from the opening/closing member 330 to the shutter 310 so that the shutter 310 moves to the first position. In other words, if the photoconductive unit 100 or the developing unit 200 is not mounted, the waste toner outlet 120 of the photoconductive unit 100 is not opened even by closing the door 410 of the image forming apparatus.

As can be appreciated from the above, the process cartridge 500 according to an embodiment of the present invention allows the waste toner outlet 120 of the photoconductive unit 100 to be opened only when the photoconductive unit 100 and the developing unit 200 are both mounted to the main body 400 of the image forming apparatus, and the door 410 is closed, at the same time. For example, if the door 410 is closed with the developing unit 200 is unmounted, or if the door 410 is not closed, the waste toner outlet 120 of the photoconductive unit 100 is not opened. As a result, undesired leakage of the toner can be prevented, which occurs in the conventional structure, when the waste toner outlet 120 of the photoconductive unit 100 is opened by closing the door 410 with the photoconductive unit 100 being mounted to the main body 400.

Figure 5:
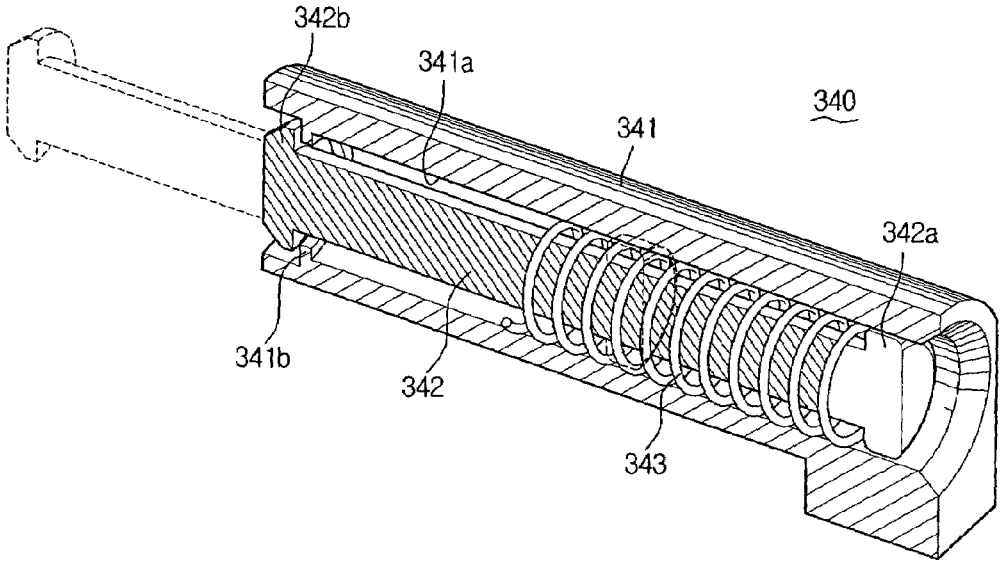
FIG. 5 is a partially cut-away perspective view showing an auxiliary opening/closing member mounted to the developing unit of FIG. 4.
Figure 6:
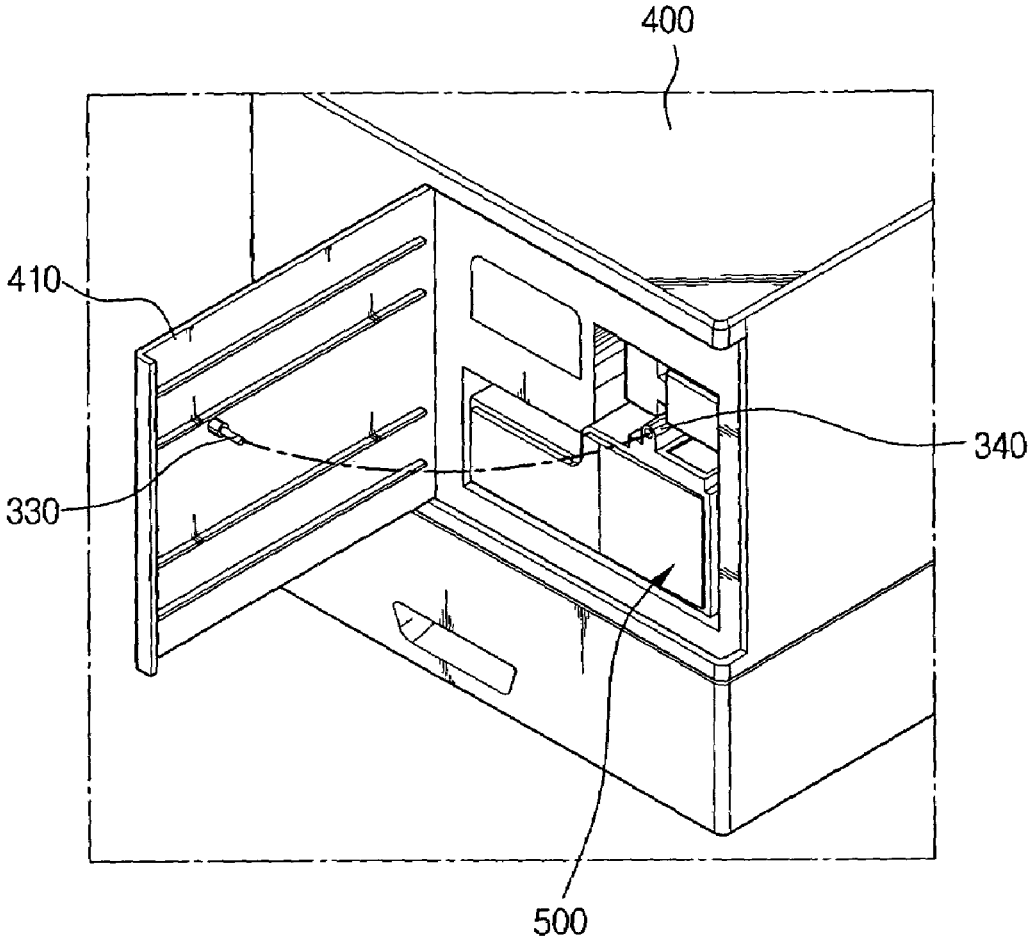
FIG. 6 is a schematic view of an image forming apparatus utilizing a process cartridge according to an embodiment of the present invention.

As shown in FIG. 5, the auxiliary opening/closing member 340 comprises a housing 341 having a hole 341*a* formed in a moving direction of the shutter 310, a moving bar 342 mounted in the hole 341*a* to move in a sliding manner and a second elastic member 343 for elastically supporting the moving bar 342 to an initial position.

As the door 410 is closed, the moving bar 342 is protruded from the housing 341 in a direction to the first position of the opening/closing member 330, thereby pushing the shutter 310. When the opening/closing member 330 is moved to the second position, the moving bar 342 returns to the initial position by an elastic recovery force of the second elastic member 343 and therefore received in the housing 341.

The second elastic member 343 is made of a compression coil spring enclosing the moving bar 342, however, the present invention is not limited thereto. Other structures can be substituted for or added to complement the second elastic member 343 as long as it can move the moving bar 342 to the initial position.

The housing 341 has therein a threshold rib 341*b*, and the moving bar 342 has a first hooking projection 342*a* for preventing separation of the moving bar 342 and a second hooking projection 342*b* for initializing a position of the moving bar 342.

Hereinbelow, the operation of opening and closing the waste toner outlet 120 of the process cartridge 500 according to an embodiment of the present invention will now be described with reference to FIGS. 7A, 7B, 8A and 8B.

Figure 7B:
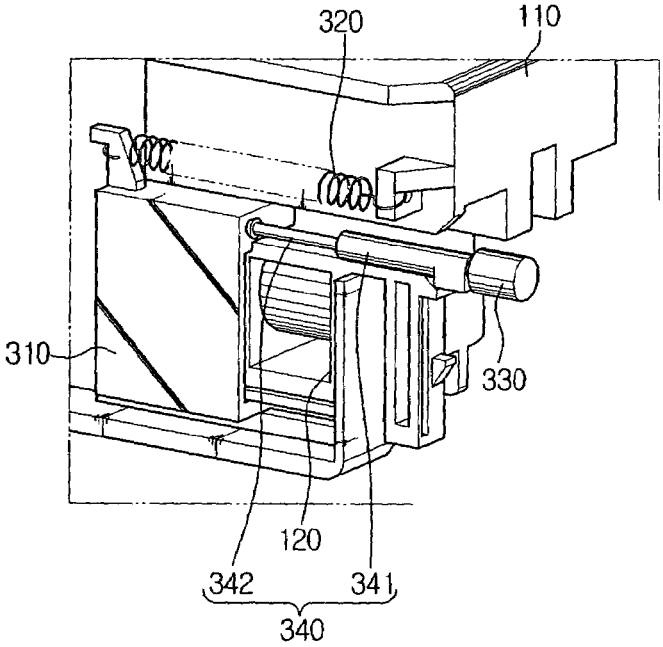

FIGS. 7A and 7B illustrate a state that the process cartridge 500 is mounted in the main body 400 of the image forming apparatus in which the photoconductive unit 100 and the developing unit 200 are connected. More specifically, the door 410 is opened in FIG. 7A whereas the door 410 is closed in FIG. 7B.

As illustrated, the auxiliary opening/closing member 340 mounted in the developing unit 200 is disposed between the shutter 310 and the opening/closing member 330 by connection of the developing unit 200 and the photoconductive unit 100. If the door 410 (FIG. 6) is closed in this state, the opening/closing member 330 moves as shown in FIG. 7B, and accordingly, the moving bar 342 of the auxiliary opening/closing member 340 protrudes from the housing 341 and therefore pushing the shutter 310. As a result, the waste toner outlet 120 of the photoconductive unit 100 is opened.

If the door 410 (FIG. 6) is opened, the opening/closing member 330 moves as shown in FIG. 7A. Accordingly, the moving bar 342 of the auxiliary opening/closing member 340 returns to its initial position by the elastic recovery force of the second elastic member 343. Also, the shutter 310 returns to its initial position by the elastic recovery force of the first elastic member 320, thereby closing the waste toner outlet 120 of the photoconductive unit 100.

Figure 8A:
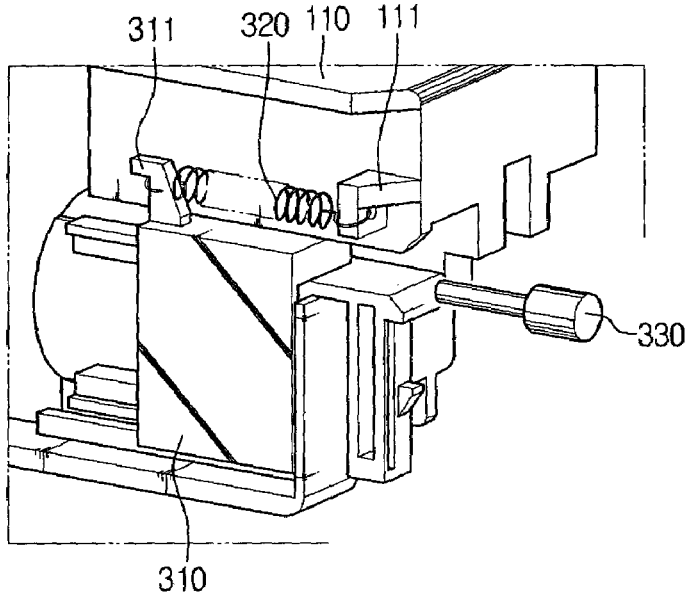
FIGS. 8A and 8B are views for explaining the operation of the opening/closing unit of the waste toner outlet in a state that the developing unit is separated.
Figure 8B:
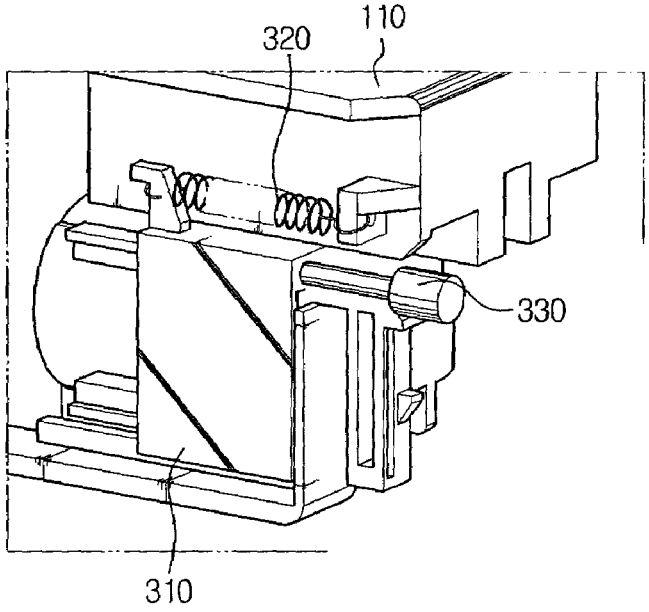

FIGS. 8A and 8B illustrate the operation of the opening/closing unit 300 according to an opening and closing state of the door 410, in a state that only the photoconductive unit 100 is mounted in the image forming apparatus.

Since the photoconductive unit 100 is not connected with the developing unit 200 in FIG. 8A, the shutter 310 and the opening/closing member 330 maintain a predetermined distance therebetween and first elastic member 320 remains in its initial position.

In this state as shown in FIG. 8A, although the door 410 is closed, the opening/closing member 330 cannot push the shutter 310, as shown in FIG. 8B. Therefore, the waste toner outlet 120 of the photoconductive unit 100 is not opened with the developing unit 200 is unmounted. Again, the first elastic member 320 remains in its initial position.

As described above, the process cartridge 500 of the image forming apparatus, according to an embodiment of the present invention, allows the waste toner outlet 120 of the photoconductive unit 100 to be opened only when both the photoconductive unit 100 and the developing unit 200 are mounted to the main body 400, with the door 410 closed at the same time.

As can be appreciated from the above description, according to the process cartridge 500 of embodiments of the present invention, toner can be prevented from leaking through the waste toner outlet 120 of the photoconductive unit 100. Therefore, contamination of an inner side of the image forming apparatus by the leaked toner can also be prevented, consequently improving an image quality.

While the invention has been shown and described with reference to certain embodiments thereof, it will be understood by those skilled in the art that various changes in form and details may be made therein without departing from the spirit and scope of the invention as defined by the appended claims.

What is claimed is:

1. A process cartridge comprising a photoconductive unit, which comprises a waste toner outlet and a shutter for closing the waste toner outlet, and a developing unit, which is removably mounted to the photoconductive unit, and comprises a waste toner storage for storing a waste toner discharged through the waste toner outlet, and is removably mounted in a main body of an image forming apparatus, wherein the shutter moves in association with an opening and closing operation of a door of the image forming apparatus between a first position, where the waste toner outlet is opened, and a second position, where the waste toner outlet is closed, the process cartridge further comprising:

an auxiliary opening/closing member provided in the developing unit, being disposed between the shutter and a primary opening/closing member of the door by mounting the photoconductive unit and the developing unit in order to transfer to the shutter an external force applied from the primary opening/closing member.

2. The process cartridge of claim 1, further comprising a first elastic member for elastically supporting the shutter toward the second position.

3. The process cartridge of claim 2, wherein the auxiliary opening/closing member comprises:

a housing having a hole formed in a moving direction of the shutter;

a moving bar movably disposed in the hole of the housing and protruding from the housing as the primary opening/closing member moves to the first position of the shutter; and a second elastic member elastically supporting the moving bar to return the protruded moving bar to its initial position.

4. The process cartridge of claim 3, wherein the first elastic member is formed as a tension coil spring of which one end is connected to the photoconductive unit and the other end is connected to the shutter, and the second elastic member is formed as a compression coil spring enclosing an outer circumference of the moving bar.

5. A image forming apparatus comprising:

a photoconductive unit having a waste toner outlet and a shutter for closing the waste toner outlet;

a developing unit removably mounted to the photoconductive unit and having a waste toner storage for storing a waste toner discharged through the waste toner outlet;

a main body for receiving and supporting the photoconductive unit and the developing unit and having an openable door; and a primary opening/closing member for moving in association with an opening and closing movement of the door, thereby moving the shutter to a position for opening the waste toner outlet, wherein the waste toner outlet is not opened if the door is closed with the developing unit unmounted, or if the door is not closed.

6. An image forming apparatus comprising:

a photoconductive unit having a waste toner outlet and a shutter for closing the waste toner outlet;

a developing unit removably mounted to the photoconductive unit and having a waste toner storage for storing waste toner discharged through the waste toner outlet and an auxiliary opening/closing member disposed close to the shutter to help opening of the shutter;

a main body for receiving and supporting the photoconductive unit and the developing unit and having a door; and a primary opening/closing member moving in association with an opening and closing movement of the door, thereby moving the shutter to a position for opening the waste toner outlet, wherein the auxiliary opening/closing member is disposed between the shutter and the primary opening/closing member by mounting the photoconductive unit and the developing unit, and when the door is closed, the primary opening/closing member operates the auxiliary opening/closing member so that the auxiliary opening/closing member moves the shutter to a position for opening the waste toner outlet.

7. The image forming apparatus of claim 6, wherein the waste toner outlet is not opened if the door is closed with the developing unit unmounted, or if the door is not closed.

8. An image forming apparatus comprising:

a process cartridge having a photoconductive unit, which comprises a waste toner outlet, and a developing unit removably mounted to the photoconductive unit and comprising a waste toner storage for storing a waste toner discharged through the waste toner outlet;

a main body for receiving and supporting the process cartridge and having an openable door; and an opening/closing unit for opening and closing: the waste toner outlet of the photoconductive unit in association with an opening and closing operation of the door, wherein the opening/closing unit comprises:

a shutter moving between a first position for opening the waste toner outlet and a second position for closing the waste toner outlet;

a primary opening/closing member formed at the door to move the shutter to the first position; and an auxiliary opening/closing member provided in the developing unit, being disposed between the shutter and the primary opening/closing member by mounting the photoconductive unit and the developing unit in order to transfer to the shutter an external force applied from the primary opening/closing member.

9. The image forming apparatus of claim 8, wherein the auxiliary opening/closing member comprises:

a housing having a hole formed in a moving direction of the shutter;

a moving bar movably disposed in the hole of the housing and protruding from the housing as the primary opening/closing member moves to the first position of the shutter; and a second elastic member elastically supporting the moving bar to return the protruded moving bar to its initial position.

10. The image forming apparatus of claim 9, wherein the first elastic member is formed as a tension coil spring of which one end is connected to the photoconductive unit and the other end is connected to the shutter, and the second elastic member is formed as a compression coil spring enclosing an outer circumference of the moving bar.

* * * * *